US007175742B2

(12) United States Patent
Takeuchi et al.

(10) Patent No.: US 7,175,742 B2
(45) Date of Patent: Feb. 13, 2007

(54) DOCTOR BLADE

(75) Inventors: Tetsuo Takeuchi, Tokyo (JP); Hirofumi Ishii, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 567 days.

(21) Appl. No.: 10/245,088

(22) Filed: Sep. 17, 2002

(65) Prior Publication Data

US 2003/0051846 A1 Mar. 20, 2003

(30) Foreign Application Priority Data

Sep. 19, 2001 (JP) ..... 2001-285008

(51) Int. Cl.
*B31F 1/12* (2006.01)

(52) U.S. Cl. ..... 162/281; 162/263; 162/199; 15/298.1; 15/256.51; 15/256.5; 428/114; 118/123; 118/413

(58) Field of Classification Search ..... 162/263, 162/281, 199; 15/298.1, 256.51, 256.5, 298.7; 428/414; 399/350; 118/123, 413
See application file for complete search history.

(56) References Cited

U.S. PATENT DOCUMENTS 3,446,693 A * 5/1969 Alig et al. ..... 442/77
6,643,890 B2 * 11/2003 Carrier ..... 15/256.51

FOREIGN PATENT DOCUMENTS

JP 56-20697 * 2/1981

* cited by examiner

*Primary Examiner*—Mark Halpern
(74) *Attorney, Agent, or Firm*—Howson & Howson LLP

(57) ABSTRACT

In a doctor blade, which suppresses abrasion of a mating member and excels in water removal capability and shape retention capacity over a long time, resin is impregnated into a fibrous laminate composed of base materials and batt layers integrated by needle punching, and an adjustment is made so that the void content is between 50% and 80%.

4 Claims, 7 Drawing Sheets

FIG.4

| Structural part | Item | Comparative example-1 | Example -1 | Example -2 | Example -3 | Example -4 | Comparative example-2 |
|---|---|---|---|---|---|---|---|
| Fiber part | Base material | PET basis weight 100g/m$^2$ | ← | ← | ← | ← | ← |
| | Batt material | Polyamide fiber N66, 17dtex | ← | ← | ← | ← | ← |
| | Batt basis weight | 120g/m$^2$ | ← | ← | ← | ← | ← |
| | Density(g/cm$^3$) | 0.20 | 0.25 | ← | ← | ← | ← |
| | Space occupational rate(%) | 17.5 | 21.9 | ← | ← | ← | ← |
| Resin part | Material | SBR | ← | ← | ← | ← | ← |
| | Density(g/cm$^3$) | 1.0 | ← | ← | ← | ← | ← |
| | Resin impregnation rate(R/F)% | 5 | 15 | 50 | 75 | 90 | 120 |
| | Space occupational rate(%) | 1.00 | 3.75 | 12.50 | 18.75 | 22.50 | 30.00 |
| The whole | Void content(%) | 81.5 | 74.4 | 65.6 | 59.4 | 55.6 | 48.1 |
| Abrasion performance | Compared by ratio | 185 | 170 | 140 | 130 | 110 | 90 |
| Water removing capability | Compared by ratio | 190 | 230 | 200 | 180 | 150 | 120 |
| Shape retention capacity | | × | △ | ○ | ○ | ○ | ○ |

FIG.5

| Structural part | Item | Comparative example-3 | Example-5 | Example-6 | Example-7 | Example-8 | Comparative example-4 | Conventional example-1 |
|---|---|---|---|---|---|---|---|---|
| Fiber part | Base material | PET basis weight 100g/m$^2$ | ← | ← | ← | ← | ← | ← |
| | Batt material | PET fiber 17dtex | ← | ← | ← | ← | ← | ← |
| | Batt basis weight | 120g/m$^2$ | ← | ← | ← | ← | ← | ← |
| | Density(g/cm$^3$) | 0.20 | 0.35 | ← | ← | ← | ← | 0.55 |
| | Space occupational rate(%) | 14.5 | 25.4 | ← | ← | ← | ← | 39.9 |
| Resin part | Material | SBR | ← | ← | ← | ← | ← | ← |
| | Density(g/cm$^3$) | 1.0 | ← | ← | ← | ← | ← | ← |
| | Resin impregnation rate(R/F)% | 5 | 5 | 20 | 40 | 60 | 80 | 30 |
| | Space occupational rate(%) | 1.00 | 1.8 | 7.00 | 14 | 21.00 | 28.00 | 16.50 |
| The whole | Void content(%) | 84.5 | 72.9 | 67.6 | 60.6 | 53.6 | 46.6 | 43.6 |
| Abrasion performance | Compared by ratio | 200 | 175 | 160 | 140 | 120 | 110 | 100 |
| Water removing capability | Compared by ratio | 170 | 220 | 190 | 170 | 140 | 110 | 100 |
| Shape retention capacity | | × | △ | ○ | ○ | ○ | ○ | ○ |

FIG.6

| Structural part | Item | Comparative example-3 | Example-9 | Example-10 | Example-6 | Example-11 | Example-12 | Example-13 | Conventional example-1 |
|---|---|---|---|---|---|---|---|---|---|
| Fiber part | Base material | PET basis weight 100g/m$^2$ | ← | ← | ← | ← | ← | ← | ← |
| | Batt material | PET fiber 17dtex | ← | ← | ← | ← | ← | ← | ← |
| | Batt basis weight | 120g/m$^2$ | ← | ← | ← | ← | ← | ← | ← |
| | Density(g/cm$^3$) | 0.20 | 0.25 | 0.3 | 0.35 | 0.4 | 0.45 | 0.5 | 0.55 |
| | Space occupational rate(%) | 14.5 | 18.1 | 21.7 | 25.4 | 29.4 | 32.6 | 36.2 | 39.9 |
| Resin part | Material | SBR | ← | ← | ← | ← | ← | ← | ← |
| | Density(g/cm$^3$) | 1.0 | ← | ← | ← | ← | ← | ← | ← |
| | Resin impregnation rate(R/F)% | 5 | 50 | 30 | 20 | 15 | 10 | 10 | 30 |
| | Space occupational rate(%) | 1.0 | 12.5 | 9.0 | 7.0 | 6.0 | 4.5 | 5.0 | 16.5 |
| The whole | Void content(%) | 84.5 | 69.4 | 69.3 | 67.6 | 65.0 | 62.9 | 58.8 | 43.6 |
| Abrasion performance | Compared by ratio | 200 | 130 | 150 | 160 | 130 | 120 | 110 | 100 |
| Water removing capability | Compared by ratio | 170 | 200 | 190 | 190 | 180 | 150 | 130 | 100 |
| Shape retention capacity | | × | ○ | ○ | ○ | ○ | ○ | ○ | ○ |

FIG.7

| Structural part | Item | Comparative example-3 | Example-5 | Example-6 | Example-14 | Example-15 | Conventional example-1 |
|---|---|---|---|---|---|---|---|
| Fiber part | Base material | PET basis weight 100g/m$^2$ | ← | ← | ← | ← | ← |
| | Batt material | PET fiber 17dtex | ← | ← | ← | ← | ← |
| | Batt basis weight | 120g/m$^2$ | ← | ← | ← | ← | ← |
| | Density(g/cm$^3$) | 0.20 | 0.35 | ← | ← | ← | 0.55 |
| | Space occupational rate(%) | 14.5 | 25.4 | ← | ← | ← | 39.9 |
| Resin part | Material | SBR | ← | ← | ← | ← | ← |
| | Density(g/cm$^3$) | 1.0 | ← | ← | ← | ← | ← |
| | Resin impregnation rate(R/F)% | 5 | 5 | 20 | 20 | 20 | 30 |
| | T(mm) | 10 | 10 | 10 | 5 | 3 | |
| | Space occupational rate(%) | 1.0 | 1.8 | 7.00 | 7.00 | 7.00 | 16.50 |
| The whole | Void content(%) | 84.5 | 72.9 | 67.6 | 53.6 | 53.6 | 43.6 |
| Abrasion performance | Compared by ratio | 200 | 175 | 160 | 170 | 190 | 100 |
| Water removing capability | Compared by ratio | 170 | 220 | 190 | 200 | 180 | 100 |
| Shape retention capacity | | × | △ | ○ | ○ | ○ | ○ |

DOCTOR BLADE

CROSS REFERENCE TO RELATED APPLICATION

This application claims priority from Japanese patent application 285008, filed Sep. 9, 2001.

FIELD OF THE INVENTION

This invention relates to a doctor blade, and more particularly to a doctor blade suitable for removing water from an elastic belt at the press part of a papermaking machine.

BACKGROUND OF THE INVENTION

FIG. 8 shows a typical shoe press apparatus at the press part N of a papermaking machine. In this shoe press apparatus, a pair of felts F, and an endless elastic belt B, having no air permeability, are pinched between a press roll P and shoe S. When the press roll P rotates in the direction of an arrow P', the belt B also rotates in the direction of arrow B'. As a wet paper web W passes through the press part N between the felts F, water is squeezed from the web.

Oil is supplied to the inside of the elastic belt B to reduce friction against the shoe S.

Since the surface of the shoe S is opposed to the outer surface of the press roll P, the area of the press part N is large compared to the area of the press part in an apparatus composed of a pair of press rolls, and a greater water squeezing effect is achieved.

Therefore, this shoe press apparatus has the advantage that the energy expended in drying the wet paper web W is significantly reduced.

As shown in FIG. 9, which is an enlarged cross-sectional view showing the structure of an elastic belt B used in the above-described shoe press apparatus, the belt comprises a base member b, and high molecular weight elastic members e, which are provided on both sides of the base member b. The base member b is provided to impart strength to the elastic belt B as a whole. A woven fabric, having a warp and weft, is typically used as the base member.

The high molecular weight elastic members e, which form both the felt contacting surface and the shoe contacting surface of the elastic belt, are composed of a resin having a hardness of 70 to 98, such as urethane resin, etc.

A plurality of grooves (not shown) may be provided, optionally, on the felt contacting surface of the belt B, so that water squeezed from the wet paper web W in the press part N may be held in the grooves.

Compressed air is supplied to the inside of the endless elastic belt B to expand it into a cylindrical shape as shown in FIG. 8.

In the press part N, water, which is squeezed from the wet paper web W, moves to the elastic belt B through a felt F as the paper web W is pinched.

Although most of the water which moves to the elastic belt B is shaken off in the direction of arrow a in FIG. 8 as a result of movement of the elastic belt B, part of the water sometimes continues to adhere to the belt, and re-enters the press part. Thus, water adhering to the belt may not be squeezed adequately from the wet paper web W.

To address the problem of re-entry of the adhering water into the press part, a doctor blade has been proposed to remove the water adhering to the roll. The blade may be a metallic doctor blade, or a doctor blade having a felt impregnated with rubber or resin as disclosed in Unexamined Japanese Patent Publication No. 20697/1981.

However when these doctor blades applied to an elastic belt such as belt B, the result is not entirely satisfactory. For example, although a metallic doctor blade is highly effective in removing water from an elastic belt, it causes the elastic belt to wear out rapidly. Moreover, when the elastic belt is expanded by compressed air, it is not necessarily straight in the cross machine direction, and therefore it is difficult to ensure that the metallic doctor blade is in uniform contact with the elastic belt. There is also a risk of damage to the elastic belt caused by digging of the tip of the metallic doctor blade into to the elastic belt.

In the case of a doctor blade composed of a felt impregnated with rubber, resin, or the like, it is necessary to minimize the amount of impregnated material in order to improve adhesion to the elastic belt B. However, lessening of the amount of impregnated material impairs the shape retention of the doctor blade, allowing it to deform in use, with the result that its water removing capability deteriorates.

The invention addresses the above problems by providing a doctor blade comprising a fibrous laminate impregnated with resin, and having a void content between 50% and 80%. Preferably, the fibrous laminate includes at least one base material layer and plural fibrous layers. Where the fibrous laminate comprises inner and outer fibrous layers, preferably fibers of at least a portion of one of the outer layers capable of contacting a mating member, are thinner than the fibers of the other fibrous layers of the laminate.

With its void content adjusted to the range between 50% and 80%, the doctor blade according to the invention readily and easily adapts itself to the contacting surface of a mating member, e.g., an elastic belt, from which water is to be removed. The doctor blade also exhibits improved water removal capability, enhanced durability, and reduced abrasion of, and minimal damage to, the mating member. In addition, the doctor blade according to the invention exhibits excellent shape retention.

BRIEF DESCRIPTION OF DRAWINGS

FIG. 4 is a table showing the results of water removing capability, abrasion, and shape retention tests on four examples of doctor blades in accordance with the invention and also on two comparative examples;

FIG. 5 is a table showing the results of water removing capability, abrasion, and shape retention tests on four more examples of doctor blades in accordance with the invention, on two more comparative examples, and on a conventional example;

FIG. 6 is a table showing the results of water removing capability, abrasion, and shape retention tests on five more examples of doctor blades in accordance with the invention and on a comparative example and a conventional example.

FIG. 7 is a table showing the results of water removing capability, abrasion, and shape retention tests on two more examples of doctor blades in accordance with the invention and on a comparative examples and a conventional example;

DETAILED DESCRIPTION OF THE PREFERRED EMBODIMENTS

Figure 1A:
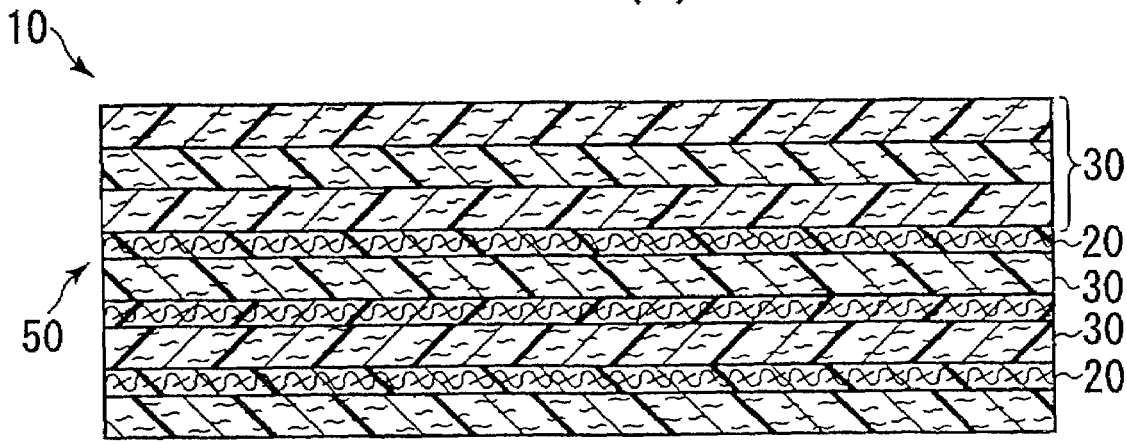
FIG. 1A is a cross-sectional view of a portion of a doctor blade according to the invention.

As shown in FIG. 1A, the doctor blade 10 according to the invention is a fibrous laminate 50, composed of base material layers 20 and batt layers 30 impregnated with resin.

Although each base material layer 20 is usually a woven fabric, or yarn layer, etc., composed of universal fibers, a film, or spun bond or molded resin or the like, may be used. In the batt fiber layer 30 yarns of general-purpose fiber are stratified. In the laminate 50, a plurality of base material layers 20 and a plurality of fibrous layers 30 are laminated and integrated. However, there are also cases in which base material layers are not used, and the laminate is composed only of fibrous layers.

In the laminate 50, a plurality of base material layers 20 and a plurality of fibrous layers 30 may be laminated and intertwiningly integrated by needle punching all at the same time. Alternatively, separate units composed of base material layers 20 and fibrous layers 30 may be integrated by needle punching, and thereafter laminated and integrated with other similar units by needle punching.

Though a universal fiber such as polyamide fiber, polyester fiber, and the like may be used as a base material 20 and fibrous layer 30, it is desirable to use aromatic polyamide fiber and the like when a heat resistance is required.

The base material layers 20 and the fibrous layers 30 may be glued together by a resin or the like. However, integration by needle punching has the advantage that it suppresses peeling of the layers from one another.

After the laminate 50 is impregnated with the resin solution, the resin is hardened by the application of heat, and cut. If desired, the edge of the doctor blade may be tapered by machining. Doctor blades 10*b* and 10*c* having the shapes shown in FIGS. 1B and 1C may be obtained.

A hardener or additive is mixed or scattered into thermoplastic resin and/or a thermosetting resin such as butadiene-styrene rubber (synthetic rubber produced by styrene-butadiene copolymerization), polyurethane, acrylic resin, epoxy resin, or phenolic resin is used as a resin solution and an adjustment is carried out so that the void content of the doctor blade after hardening and impregnating is between 50% and 80%.

In selecting the resin, wear resistance and hydrolysis resistance, etc., are taken into consideration. Either a single resin, or a mixture of several kinds of resin may be used.

Impregnation of resin into the laminate 50 can be carried out by the familiar method of spraying. Alternatively, impregnation of resin into the laminate may be carried out by another method in which fine particles of resin are impregnated into the surface of the laminate 50, and heated and pressurized, by means of a press. In either case it is necessary to consider wear resistance and flexibility.

The void content of doctor blades 10, 10*b*, 10*c* may be adjusted by controlling the density of the laminate 50 or the amount of impregnated resin. Moreover, the void content may be adjusted by adding a foaming agent to the resin solution or to the fine resinous particles.

Sprinkling a thermoplastic binder when mixing heat-meltable fiber with a fibrous layer 30, and then integrating the fibrous layer with a base layer by needling etc., or sprinkling a thermoplastic binder after integration and heating before impregnating the laminate with a resin solution, will cause the fibers to stick together and prevent the loss of fibers from the doctor blade.

Moreover, when a lubricating additive such as molybdenum disulfide is added to the solution or fine resin particles, friction drag of the doctor blade against an elastic belt can be decreased.

In the laminate 50 of the doctor blades 10, 10*b*, and 10*c*, the fibers which compose the layer which contacts the mating elastic belt, are preferably thinner than the fibers composing the layers which do not contact the elastic belt. When the contacting layer is composed of these thinner fibers, adhesion of the doctor blade to the elastic belt increases.

Figure 2:
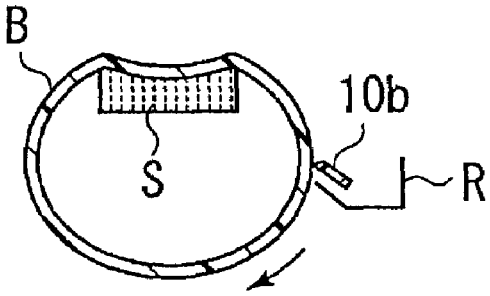
FIG. 2A is a schematic view showing a doctor blade of FIG. 1B in a shoe press apparatus, where only a tip of the doctor blade is pressed against an elastic belt.
FIG. 2B is a schematic view showing the doctor blade of FIG. 1B pressed against an elastic belt.
Figure 2:
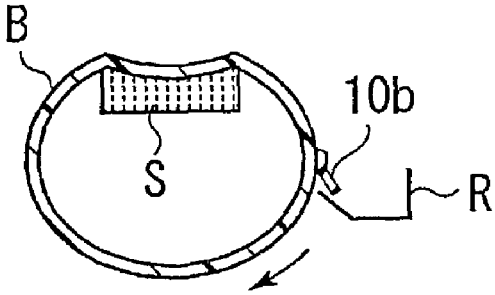

FIGS. 2A and 2B show a doctor blade 10*b* according to the invention used in a shoe press apparatus. The doctor blade may be used either with its tip in contact with an elastic belt B as shown in FIG. 2A, or in a deflected condition, as shown in FIG. 2B, where a portion of a surface of the blade is in contact with the elastic belt B so that the area of the blade which is in contact with the belt B is broadened.

Figure 1B:
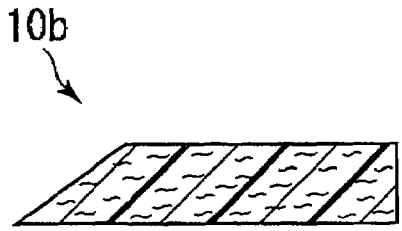
FIG. 1B is an enlarged partial cross-sectional view of the doctor blade having a tapered end, but without showing the details of the laminates.
Figure 1C:
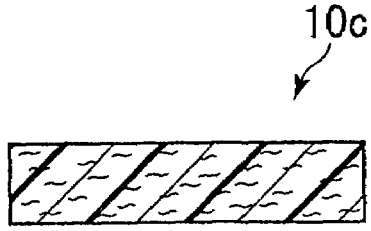
FIG. 1C is a cross-sectional view of a doctor blade having a rectangular cross-section, but without showing the details of the laminates.

The doctor blade of FIG. 1B which has a tapered tip formed by machining, can be used either with the machined surface facing upward, or may be reversed so that its machined surface faces downward in use.

As shown in FIGS. 2A and 2B, water removed by the doctor blade 10*b* flows into a water receiver R.

Examples of doctor blades according to the invention were made and tested, as explained below with reference to FIGS. 4–7.

In Examples 1–4, the base material was a woven fabric of plain weave, composed of spun polyester (PET) yarns both as warp and weft yarns, and having a basis weight 100 g/m$^2$. The fibrous layer was composed of polyamide fibers N66 17 dtex, having a density of 1.14 g/cm$^3$.

The base material was integrated with the polyamide fiber layer by needling, and fibrous layers were provided on both sides of the base material to form an integrated unit. The amount of the polyester fiber in each layer was 120 g/m$^2$.

Three such integrated units were piled up and integrated by needling. Moreover, polyamide fiber 120 g/m$^2$ was integrated with the integrated units by needling, and a laminate having an areal weight (Metsuke) of 2500 g/m$^2$, a thickness of 10 mm as a whole, and a density of 0.25 g/cm$^3$ was obtained.

Styrene butadiene latex (SBL) and a hardener were then mixed and diluted with water, and the solution was spread over and impregnated into the above laminate. The laminate was dried, hardened and cut in the direction of the needles and a taper, as shown in FIG. 1B, was produced by machining.

In the doctor blades of Examples 1–4, the adhesion ratio of the solid resin to the laminate (that is, the ratio R/F, of the resin weight R to the fiber weight F of the laminate) differed from example to example, the adhesion ratios being 15% in Example 1, 50% in Example 2, 75% in Example 3, and 90% in Example 4. In each case, the void content was adjusted to a value between 50% and 80%, Thus, the void content was 74.4% in Example 1, 65.6% in Example 2, 59.4% in Example 3, and 55.6% in Example 4.

In doctor blades of Comparative examples 1 and 2, which had a structure similar to that of Examples 1–4, the adhesion ratios were 5% and 120%, respectively, and the void contents were 81.5% in Comparative example 1 and 48.1% in Comparative example 2.

Figure 3:
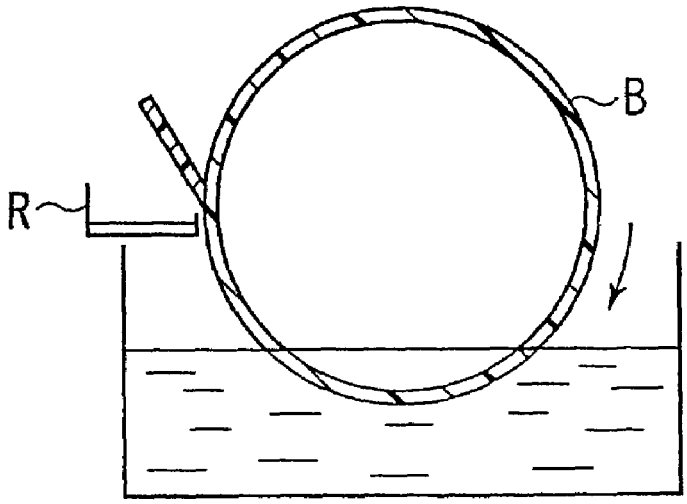
FIG. 3 is a schematic view of an apparatus for conducting water removing capability, abrasion, and shape retention tests on doctor blades.
Figure 8:
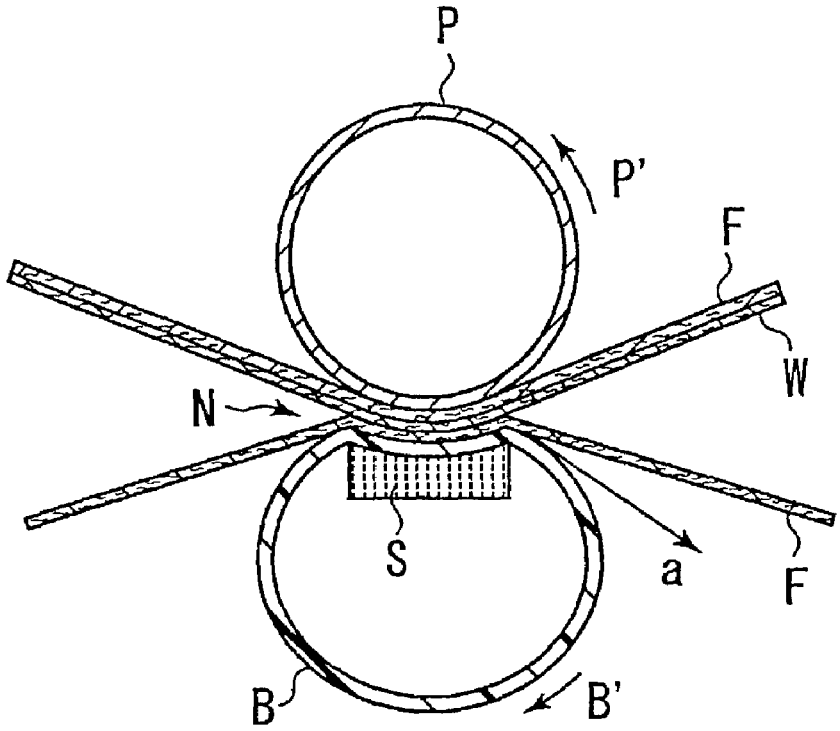
FIG.8 PRIOR ART
FIG. 8 is a schematic view of a shoe press apparatus used in the press part of a papermaking machine.
Figure 9:
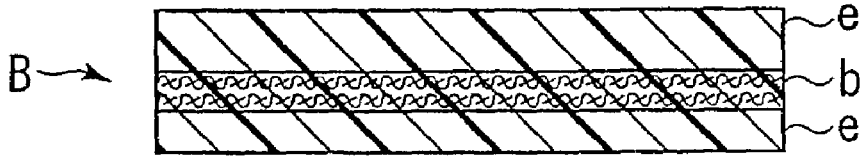
FIG.9 PRIOR ART
FIG. 9 is an enlarged cross-sectional view of an elastic belt used in a shoe press apparatus.

Water removing capability tests, abrasion tests and shape retention characteristic tests of these doctor blades were conducted using the apparatus shown in FIG. 3.

This apparatus measured the amount of removed water and the abrasion loss of the belt B, by rotating the endless belt B in the direction of the arrow of FIG. 3 with part of the belt B soaked in water, and with the doctor blade in contact with the belt.

A belt made of polyurethane having a plurality of surface grooves, each 1 mm in width and 1 mm in depth, and spaced at intervals of 3 mm between grooves, was used as the belt B.

After the belt B was rotated in the testing at 60 rpm for five minutes, the amount of water removed by the doctor blade, that is, the amount of water in water receiver R, was measured to determine the water removing capability of the doctor blade.

After the belt B was rotated in the same apparatus at 100 rpm for 1000 hours, the abrasion loss of the belt B was measured, and the change of the shape of the doctor blade was also evaluated.

The test results are shown in FIG. 4. The results of the water removing capability test and the abrasion test are shown by ratio in FIG. 4. A large value in the results of the water removing capability test means a high water removing capability. Similarly, a large value in the results of the abrasion test indicates a high abrasion suppression capability. As shown in FIG. 4, the doctor blades of Examples 1–4, according to the invention, exhibited excellent water removing capability, abrasion performance, and shape retention.

On the other hand, although Comparative example 1 had a high water removing capability and good abrasion performance, it was inferior in shape retention. Moreover, although Comparative example 2 exhibited good shape retention it was inferior in water removing capability and abrasion performance.

In Examples 5–8, the base material was a woven fabric of plain weave, in which both the warp and weft were composed of polyester (PET) spun yarn (17 dtex, density 1.38 g/cm$^3$, and basis weight 100 g/m$^2$), and the fibrous layer was composed of polyester fiber (PET 17 dtex, density 1.38 g/cm$^3$). A laminate having a density of 0.35 g/cm$^3$ was formed, and the adhesion ratios of the solid resin to the laminate were 5% in Example 5, 20% in Example 6, 40% in Example 7, and 60% in Example 8.

The void content was adjusted to a value between 50% and 80%. The void content was 72.9% in Example 5, 67.6% in Example 6, 60.6% in Example 7, and 53.6% in Example 8. The structure was otherwise the same as in Examples 1–4.

In addition, comparative examples of doctor blades were made, having the same structure as that of Examples 5–8, except that the adhesion rate of the solid resin was 5% in Comparative example 3 and the adhesion rate of the solid resin in Comparative example 4 was 80%. The density of the laminate of Comparative example 3 was 0.2 g/cm$^3$ and the density of the laminate of Comparative example 4 was 0.35 g/cm$^3$. The void content of Example 3 was 84.5% and the void content of Example 4 was 46.6%.

Another doctor blade, as disclosed in Unexamined Japanese Patent Publication No. 20697/81, was made as a Conventional example. The density of the laminate of this conventional doctor blade was 0.55 g/cm$^3$, the adhesion ratio of the resin to the laminate was 30%, and the void content was 43.6%.

Water removal, abrasion, and shape retention tests were conducted on these doctor blades, using the apparatus shown in FIG. 3. The test results, tabulated in FIG. 5, show that the doctor blades of Examples 5–8 exhibited excellent water removing capability, abrasion performance, and shape retention.

Although Comparative example 3 had a high water removing capability and good abrasion performance, it was inferior in shape retention. On the other hand, although Comparative example 4 and the Conventional example exhibited good shape retention characteristics, they were inferior in water removing capability and abrasion performance.

Whereas the effect of changes in the resin adhesion rate on water removal capability, abrasion performance, and shape retention was measured in Examples 1–4 and Examples 5–8, both the density of a laminate, and the resin adhesion rate were changed in Examples 9–13.

The laminate which made up Examples 9–13 comprised a base material of plain weave woven fabric composed of polyester spun yarn (PET) as both warp and weft (basis weight 100 g/m$^2$), and a fibrous layer made of polyester fiber (PET 17 dtex).

The densities of the laminate were 0.25 g/cm$^3$ in Example 9, 0.3 g/cm$^3$ in Example 10, 0.4 g/cm$^3$ in Example 11, 0.45 g/cm$^3$ in Example 12, and 0.5 g/cm$^3$ in Example 13 and the resin contents were 50% in Example 9, 30% in Example 10, 15% in Example 11, 10% in Example 12, and 10% in Example 13, respectively.

The void content of Examples 9–13 was adjusted to a level between 50% and 80%, the void contents being 69.4% in Example 9, 69.3% in Example 10, 65.0% in Example 11, 62.9% in Example 12, and 58.8% in Example 13.

Water removal, abrasion and shape retention tests of these doctor blades, were carried out using the apparatus shown in FIG. 3, and are compared, in FIG. 6, with one another, and also with the results of tests on Example 6, Comparative example 3, and Conventional example 1.

The doctor blade of the Example 6 had a laminate density of 0.35 g/cm$^3$, a resin adhesion rate of 20%, and a void content of 67.6%.

As shown in FIG. 6, the doctor blades of Examples 9–13 and Example 6 exhibited excellent water removal capability, abrasion performance, and shape retention.

Water removal capability, abrasion performance, and shape retention were also measured for Example 5 and 6, Comparative example 3, the conventional example, and new Examples 14 and 15, to determine the effect of changes in the depth to which resin impregnates the laminate in the direction of its thickness.

Examples 5 and 6, and new Examples 14 and 15 were doctor blades using the identical laminates composed of polyester spun yarn (PET basis weight 100 g/m$^2$) as a base material and polyester (PET 17 dtex) as a fibrous layer. The depths to which resin impregnated the laminates in the direction of thickness were 10 mm in Comparative example 3, Example 5 and Example 6, 5 mm in Example 14, and 3 mm in Example 15.

The void content of the doctor blades of Examples 5, 6, 14, and 15 was adjusted to between 50% and 80%, and the void contents were 72.9% in Example 5, 67.6% in Example 6 and 53.6% in Examples 14 and 15.

The resin adhesion rates were 5% in Comparative example 3 and Example 5, 20% in Examples 6, 14, and 15, and 30% in the Conventional example.

From the test results, shown in FIG. 7, it may be seen that the doctor blades of Examples 5, 6, 14, and 15 exhibited excellent water removal capability, abrasion performance, and shape retention.

In the doctor blades according to the invention, woven fabric having an areal weight (Metsuke) in the range of 50 to 300 g/m$^2$ and made of multi-filament or monofilament spun yarn such as polyester or polyamide, is preferable for a base material, and fibers having a fineness in the range of 3 to 80 dtex are preferable as the fibers which forms the fibrous layer.

For convenience, the density of the laminate making up a doctor blade according to the invention should be between 0.15 g/cm$^3$ and 50 g/cm$^3$, preferably between 0.2 g/cm$^3$ and 0.4 g/cm$^3$.

Although it is acceptable to adjust the resin content according to the density of the laminate, it is preferable for the ratio of the weight of the laminate to the solid resin to be between 5% and 100%. It is convenient for the ratio of the weight of resin impregnated into the laminate to the weight of the laminate to be between 5% and 100%. It is also preferable that the higher the density of the laminate is, the lower the resin content is.

The above-described doctor blade for removing water according to the invention has an effect of improving the water removing capability of an elastic belt by making the void content between 50% and 80%. A water film is formed on the surface contacting the elastic belt while the doctor blade is in use, and the adaptability of the doctor belt to the elastic belt is improved.

Although the member mating with the doctor blade according to the invention is typically the elastic belt of a shoe press apparatus as explained above in detail, the mating member from which water is removed by the doctor blade of the invention is not necessarily limited to the elastic belt of a shoe press apparatus.

As explained above, the doctor blade for removing water according to the invention is capable of adapting itself to the mating member easily, and, especially by virtue of its void content in the range between 50% and 80%, it has the effect of improved water removal capability without causing scratch markings. In addition, the doctor blade according to the invention causes little abrasion loss or other damage to the mating member. Moreover, since the doctor blade has excellent shape retention deformation due over time is minimal.

We claim:

1. In combination with a movable surface, a doctor blade for removing water from said movable surface, the doctor blade being disposed in sliding contact with said movable surface and comprising a fibrous laminate impregnated with resin, and having a void content between 50% and 80%.

2. The combination of a movable surface and a doctor blade as claimed in claim 1, wherein the fibrous laminate comprises inner and outer fibrous layers, and wherein fibers of at least a portion of one of said outer layers, said portion being capable of contacting said movable surface for removal of water from said movable surface, are thinner than the fibers of the other fibrous layers of the laminate.

3. The combination of a movable surface and a doctor blade as claimed in claim 1, wherein said fibrous laminate includes at least one base material layer and plural fibrous layers.

4. The combination of a movable surface and a doctor blade as claimed in claim 3, wherein the fibrous laminate comprises inner and outer fibrous layers, and wherein fibers of at least a portion of one of said outer layers, said portion being capable of contacting said movable surface for removal of water from said movable surface, are thinner than the fibers of the other fibrous layers of the laminate.

* * * * *

UNITED STATES PATENT AND TRADEMARK OFFICE

CERTIFICATE OF CORRECTION

PATENT NO. : 7,175,742 B2
APPLICATION NO. : 10/245088
DATED : February 13, 2007
INVENTOR(S) : Tetsuo Takeuchi and Hirofumi Ishii It is certified that error appears in the above-identified patent and that said Letters Patent is hereby corrected as shown below:

Column 1, line 7, "Sep. 9, 2001" should read --September 19, 2001--.

Signed and Sealed this

Twenty-ninth Day of May, 2007

JON W. DUDAS
*Director of the United States Patent and Trademark Office*